US009416779B2

(12) United States Patent
Gorman et al.

(10) Patent No.: US 9,416,779 B2
(45) Date of Patent: Aug. 16, 2016

(54) VARIABLE PRESSURE LIMITING FOR VARIABLE DISPLACEMENT PUMPS

(71) Applicant: Caterpillar Inc., Peoria, IL (US)

(72) Inventors: Corey L. Gorman, Peoria, IL (US); Adam Nackers, East Peoria, IL (US); Jeremiah C. Johnson, Saint John, IN (US); John J. Krone, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 97 days.

(21) Appl. No.: 14/223,698

(22) Filed: Mar. 24, 2014

(65) Prior Publication Data

US 2015/0267697 A1 Sep. 24, 2015

(51) Int. Cl.

| | |
|---|---|
| ***E02F 9/22*** | (2006.01) |
| ***F04B 49/06*** | (2006.01) |
| ***F04B 49/08*** | (2006.01) |
| ***F04B 49/22*** | (2006.01) |

(52) U.S. Cl.

CPC ..... *F04B 49/065* (2013.01); *E02F 9/2235* (2013.01); *E02F 9/2292* (2013.01); *E02F 9/2296* (2013.01); *F04B 49/08* (2013.01); *F04B 49/22* (2013.01); *F04B 2205/06* (2013.01); *F04B 2205/09* (2013.01)

(58) Field of Classification Search

USPC ..... 60/445, 446, 451, 452; 417/216, 215, 417/213

See application file for complete search history.

(56) References Cited

U.S. PATENT DOCUMENTS

| | | | | |
|---|---|---|---|---|
| 5,133,644 | A | 7/1992 | Barr et al. | |
| 5,214,916 | A * | 6/1993 | Lukich | B60W 10/103 60/431 |
| 5,468,126 | A * | 11/1995 | Lukich | F02D 29/04 123/383 |
| 5,941,689 | A | 8/1999 | Skirde | |
| 5,951,258 | A * | 9/1999 | Lueschow | F04B 49/065 417/22 |
| 6,375,433 | B1 | 4/2002 | Du et al. | |
| 6,623,247 | B2 | 9/2003 | Du | |
| 6,823,672 | B2 * | 11/2004 | Nakamura | E02F 9/2235 60/449 |
| 6,848,888 | B2 | 2/2005 | Du et al. | |
| 7,017,674 | B2 * | 3/2006 | Bell | E02F 9/2025 172/2 |
| 8,162,618 | B2 * | 4/2012 | Nakamura | E02F 9/2235 417/212 |
| 8,347,619 | B2 * | 1/2013 | Kim | E02F 9/2066 417/216 |
| 8,393,150 | B2 * | 3/2013 | Brickner | E02F 9/2235 60/443 |
| 2014/0060020 | A1 | 3/2014 | Peterson et al. | |

FOREIGN PATENT DOCUMENTS

| | | |
|---|---|---|
| EP | 2532792 | 12/2012 |
| JP | 2011122304 | 6/2011 |
| JP | 2012-137027 A | 7/2012 |
| WO | 2011133849 | 10/2011 |

* cited by examiner

*Primary Examiner* — Thomas Tarcza
*Assistant Examiner* — Richard Goldman
(74) *Attorney, Agent, or Firm* — Jeff A. Greene

(57) ABSTRACT

Method of controlling multiple variable displacement hydraulic pumps determined relative to operator commands. If non-second-pump-dominated command, a respective adjusted displacement request is determined based upon the lesser of the operator requested torque limited displacement and an adjusted torque limited displacement that calculated based upon and the torque limited displacement of the respective pump and a scaling factor calculated based upon the first relief valve set pressure and respective pump pressure. If second-pump-dominated command, the set pressure of a relief valve associated with one of the pumps is instead utilized in calculating the scaling factor in the above strategy.

21 Claims, 4 Drawing Sheets

VARIABLE PRESSURE LIMITING FOR VARIABLE DISPLACEMENT PUMPS

TECHNICAL FIELD

This patent disclosure relates generally to variable displacement pumps and, more particularly to limiting the pressure in a variable displacement pump.

BACKGROUND

Machine hydraulic systems may be utilized to drive one or more loads, such as propulsion of the machine itself, relative swing movement, or operation of a coupled arm or a work implement, either sequentially or simultaneously. In operation of such hydraulic systems, pump flow through a relief valve results in waste as fuel energy does not go to useful machine motion. Existing control strategies include a high pressure cutoff strategy, which sets the pump outflow pressure to the cracking pressure of the main relief valve. This high-pressure cutoff strategy only manages the energy loss across the main relief valve, however, leaving the remaining relief valves vulnerable to system waste.

U.S. Pat. No. 5,133,644 to Barr discloses a multi-pressure compensation arrangement that attempts to overcome this shortcoming. The pumping system of Barr includes a plurality of relief valve wherein each relief valve has a relief setting. A controller is configured to determine which relief valve is active, and then control the maximum pressure of a variable displacement pump based on the relief setting of the active relief valve.

SUMMARY

The disclosure describes, in one aspect, a method, implemented by a programmable controller, of controlling operation of at least one pump in a hydraulic system of a machine also having moveable ground engaging members. The hydraulic system also includes a first relief valve and at least a second relief valve, the second relief valve being associated with the at least one pump. The pump is a variable displacement hydraulic pump. The method includes receiving an operator request for operation of the machine. The method includes determining if the operator request includes a dominant command associated with operation of the pump. With regard to the pump, the method also includes determining a minimum of the operator requested torque limited displacement of the pump and an adjusted torque limited displacement for the pump, and setting the minimum of the operator requested torque limited displacement of the pump and the adjusted torque limited displacement for the pump as a final adjusted displacement second pump request. With regard to the pump, however, if the operator request includes the dominant command associated with operation of the pump, the method includes calculating the adjusted torque limited displacement for the pump using a pump torque limited displacement and a scaling factor based upon a current pressure at the pump and a pressure setting at the second relief valve. Conversely, if the operator request does not include the dominant command associated with operation of the pump, the method includes calculating the adjusted torque limited displacement for the pump using a pump torque limited displacement and a scaling factor based upon a current pressure at the pump and a pressure setting at the first relief valve.

In another aspect, the disclosure describes a non-transitory computer-readable medium including computer-executable instructions facilitating performing a method, implemented by a programmable controller, of controlling operation of first and second pumps in a hydraulic system in a machine including moveable ground engaging members. The first and second pumps are variable displacement hydraulic pumps and the hydraulic system further includes a first relief valve and a second valve, the second valve being associated with the second pump. The method includes receiving an operator request for operation of at least one of the first and second pumps. Relative to the first pump, the method also includes determining a minimum of the operator requested torque limited displacement of the first pump and an adjusted torque limited displacement for the first pump calculated based upon and a first pump torque limited displacement and a first pump scaling factor based upon a current pressure at the first pump and a pressure setting at the first relief valve, and providing a signal setting the minimum of the operator requested torque limited displacement of the first pump and the adjusted torque limited displacement for the first pump as a final adjusted displacement first pump request. The method further includes determining if the operator request of the pumps includes a dominant command associated with operation of the second pump. With regard to the second pump, the method also includes determining a minimum of the operator requested torque limited displacement of the second pump and an adjusted torque limited displacement for the second pump, and setting the minimum of the operator requested torque limited displacement of the second pump and the adjusted torque limited displacement for the second pump as a final adjusted displacement second pump request. With regard to the second pump, however, if the operator request includes the dominant command associated with operation of the second pump, the method includes calculating the adjusted torque limited displacement for the second pump using a second pump torque limited displacement and a scaling factor based upon a current pressure at the second pump and a pressure setting at the second relief valve. Conversely, if the operator request does not include the dominant command associated with operation of the second pump, the method includes calculating the adjusted torque limited displacement for the second pump using a second pump torque limited displacement and a scaling factor based upon a current pressure at the second pump and a pressure setting at the first relief valve.

The disclosure describes, in yet another aspect, a moveable machine having moveable ground engaging members, a chassis supported on the moveable ground engaging members, a cab swingably supported on the chassis, a hydraulic system, at least one operator interface for providing an operator request including commands for operation of the hydraulic system, and a programmable controller. The hydraulic system includes at least first and second pumps, a first relief valve, and a second relief valve associated with the second pump. The programmable controller is configured by computer-executable instructions to adjust respective pump discharge pressures of the first and second pumps. The instructions include determining and providing a signal associated with a final adjusted displacement for the first pump based at least in part on a pressure setting of the first relief valve, and determining and providing a signal associated with a final adjusted displacement for the second pump based upon at least in part on a pressure setting of the second relief valve if swing is the dominant motion command, and based upon at least in part on the pressure setting of the first relief valve if swing is not the dominant motion command. The programmable controller uses a set of parameters including the operator request, the pressure setting of the first relief valve, the pressure setting of the second relief valve, a torque limited displacement of the first pump, a torque limited displacement of the second pump, a pressure of the first pump, and a pressure of the second pump.

BRIEF DESCRIPTION OF THE DRAWING(S)

DETAILED DESCRIPTION

Figure 1:
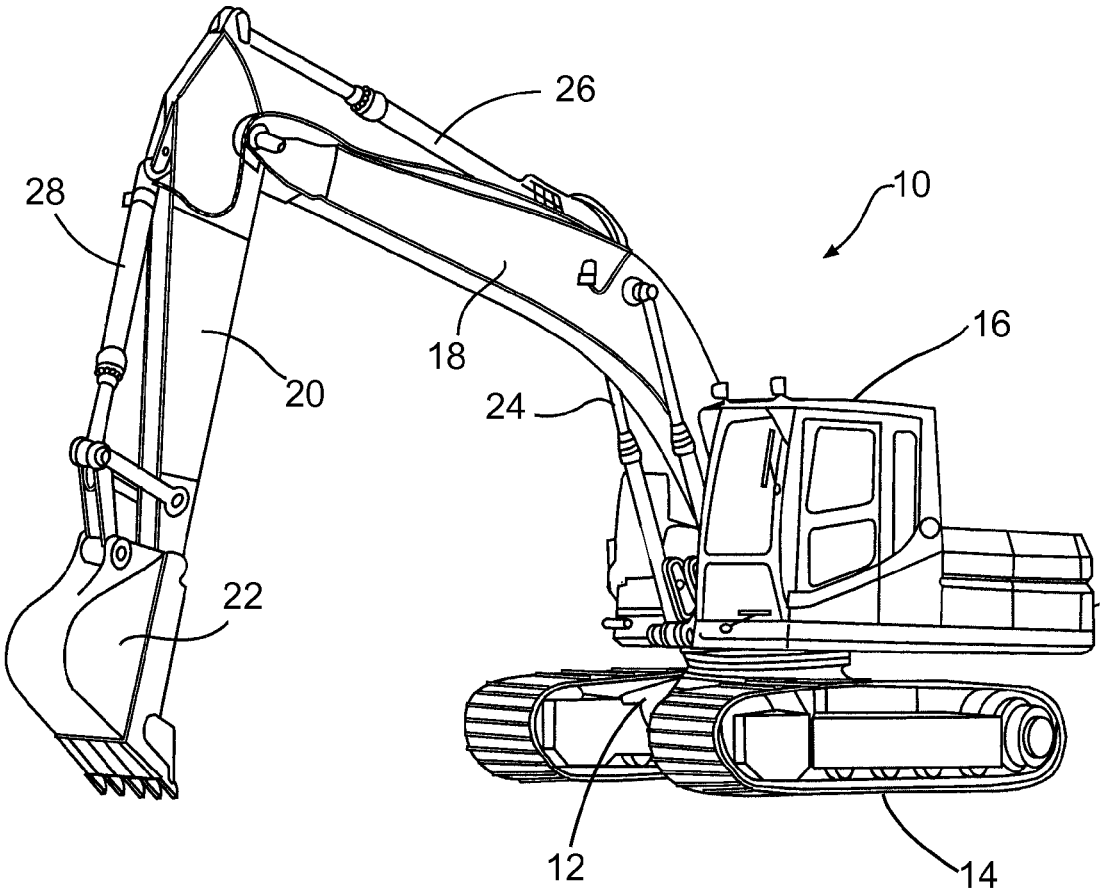
FIG. 1 is a schematic perspective view of an exemplary machine suitable for use with a system and method for managing a power system according to the present disclosure.

This disclosure generally relates to a system and method for managing a power system of a machine. FIG. 1 shows an exemplary embodiment of a machine 10 for performing work. In particular, the exemplary machine 10 shown in FIG. 1 is an excavator for performing operations such as digging and/or loading material. Although the exemplary systems and methods disclosed herein are described in relation to an excavator, the disclosed systems and methods have applications in other machines such as an automobile, truck, agricultural vehicle, work vehicle, wheel loader, dozer, loader, track-type tractor, grader, off-highway truck, or any other machines known to those skilled in the art. In this regard, the term "machine" may refer to any machine with a hydraulically powered work implement that performs some type of operation associated with an industry such as mining, construction, farming, transportation, or any other industry known in the art.

As shown in FIG. 1, the exemplary machine 10 includes a chassis 12 flanked by ground-engaging members 14 for moving the machine 10 (e.g., via ground-engaging tracks or wheels). The machine 10 includes an operator cab 16 mounted to the chassis 12 in a manner that permits rotation of the cab 16 with respect to the chassis 12. A boom 18 is coupled to the cab 16 in a manner that permits boom 18 to pivot with respect to cab 16. At an end opposite the cab 16, a stick 20 is coupled to the boom 18. The stick 20 is mounted so as to be pivotable with respect to the boom 18. An implement 22 (e.g., a digging implement or bucket) is pivotably coupled to stick 20. Although exemplary machine 10 shown in FIG. 1 includes a digging implement, other tools may coupled to the stick 20 when other types of work are desired to be performed.

In the exemplary embodiment shown, a pair of actuators 24 are coupled to the cab 16 and boom 18 in order to raise and lower the boom 18 relative to cab 16. Additionally, an actuator 26 is coupled to the boom 18 and the stick 20. Extension and retraction of the actuator 26 can pivot the stick 20 inward and outward with respect to the boom 18. A further actuator 28 is coupled to stick 20 and digging implement 22, such that extension and retraction of actuator 28 results in the digging implement or bucket 22 pivoting between closed and open positions, respectively, with respect to the stick 20. As explained in more detail with respect to FIG. 2, the actuators 24, 26, and 28 may be hydraulic devices, in particular, hydraulic actuators powered by supplying and draining fluid from cylinders on either side of a piston to cause reciprocating movement of the piston within the cylinder. While the illustrated embodiment includes hydraulic actuators, it will be understood that one or more of the actuators 24, 26, and 28 may be non-hydraulic actuators. Moreover, the number of actuators 24, 26, and 28 coupled to boom 18, stick 20, and/or implement 22 may be different than shown in FIG. 1. One or more of the hydraulic actuators also may comprise any device configured to receive pressurized hydraulic fluid and convert it into a mechanical force and motion. For example, one or more of the hydraulic actuators may additionally or alternatively include a fluid motor or hydrostatic drive train.

Figure 2:
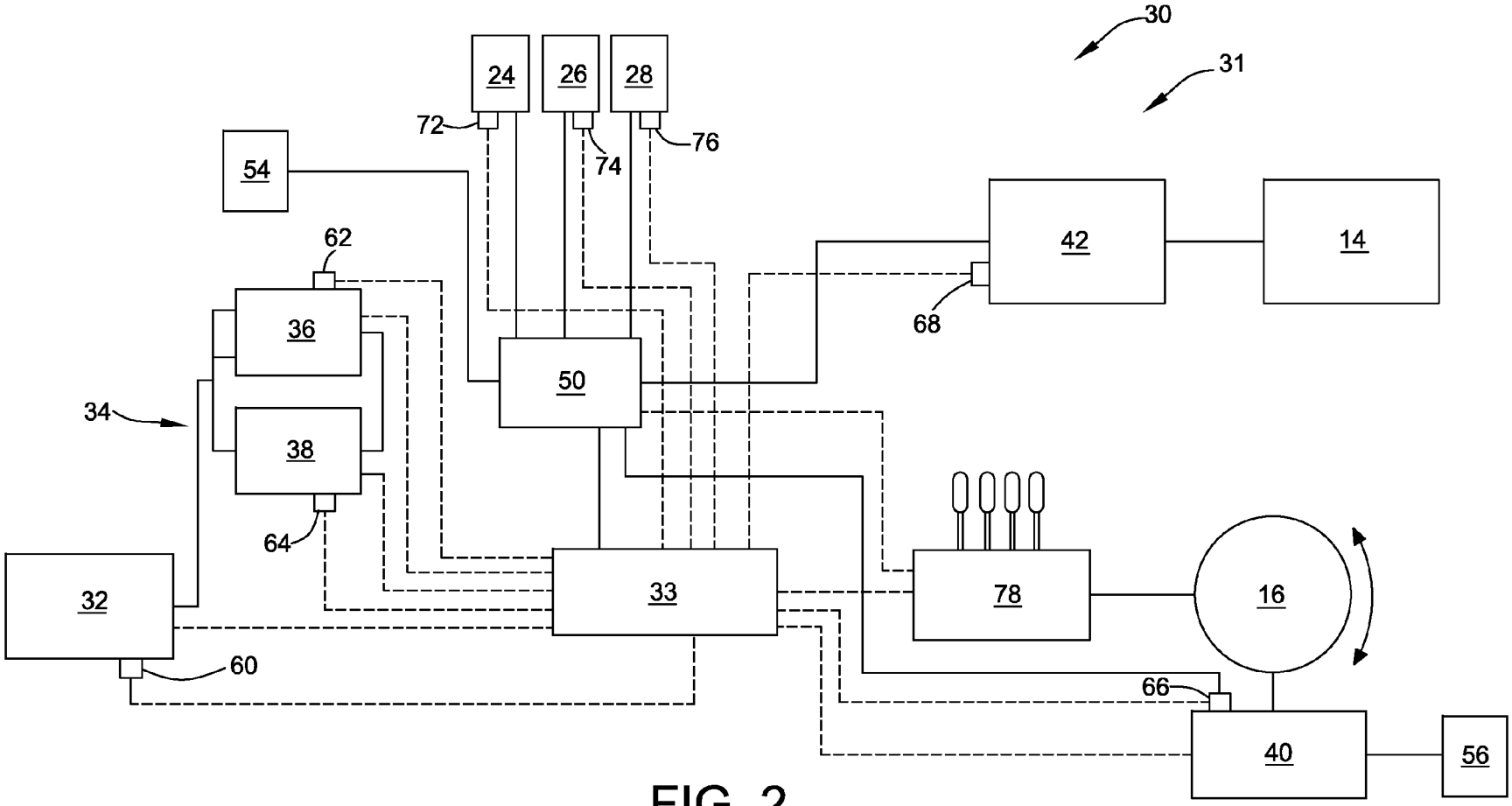
FIG. 2 is a schematic diagram of a machine power system according to the present disclosure.

Referring to FIG. 2, the machine 10 may include a power system 30 including a hydraulic system 31 having one or more hydraulic devices operated via one or more power sources and controlled by a controller 33, which manages the power system 30. In particular, the illustrated power system 30 includes an internal combustion engine 32 as a power source. The engine 32 may be, for example, a compression-ignition engine, a spark-ignition engine, a gas turbine engine, a homogeneous-charge compression ignition engine, a two-stroke engine, a four-stroke, or any type of internal combustion engine known to those skilled in the art. The engine 32 may be configured to operate on any fuel or combination of fuels, such as, for example, diesel, bio-diesel, gasoline, ethanol, methanol, or any fuel known to those skilled in the art. Further, the internal combustion engine 32 may be supplemented or replaced by another power source such as a hydrogen-powered engine, fuel-cell, solar cell, and/or any power source known to those skilled in the art. For example, an electric motor/generator may be coupled to engine 32, such that engine 32 drives motor/generator, thereby generating electric power. Additionally, the power system may include one or more electric storage devices such as batteries and/or ultra-capacitors configured to store electric energy supplied from the motor/generator and/or or any electrical energy generated by capturing energy associated with operation of machine 10, such as energy captured from regenerative braking of moving parts of 10 machine, such as, for example, ground-engaging members 14 and/or rotation of cab 16.

The engine 32 may produce a rotational output having both speed and torque components. For example, the engine 32 may contain an engine block having a plurality of cylinders (not shown), reciprocating pistons disposed within the cylinders (not shown), and a crankshaft operatively connected to the pistons (not shown). The internal combustion engine may use a combustion cycle to convert potential energy (usually in chemical form) within the cylinders to a rotational output of a crankshaft. The maximum amount of power that the engine 32 can generate may depend on its engine speed. The engine 32 may have the potential to generate greater amounts of power when running at greater speeds.

The power or torque associated with the rotating crankshaft of engine 32 may be distributed to one or more power transforming devices 34. In the exemplary embodiment shown in FIG. 2, the engine 32 is coupled to at least one hydraulic pump, here, a pair of hydraulic pumps 36, 38, which, in turn, are coupled to a hydraulic fluid source. While the hydraulic fluid source is not illustrated in FIG. 2, those of skill in the art will understand the inclusion of the same, as well as hydraulic lines coupling the various components of the hydraulic system 31.

The hydraulic system 31 may also include hydraulic pumps 40, 42, that may be devoted, at least in part, to specific operations of the machine. For example, pump 40 may be provided for rotation the cab 16 relative to the chassis 12 when an operator commands a swing motion, and pump 42 may be provided for operation of the ground engaging members 14 when travel of the machine 10 is commanded. It will be appreciated that pumps 40, 42 in particular may operate as pumps and/or motors, particularly when operating in a hybrid hydraulic system. That is, for example, the pump 40 may operate as a motor when supplied with hydraulic fluid to cause rotational motion of the cab 16 relative to the chassis 12; conversely, when such a swing motion is no longer commanded, the inertia of the cab 16 relative to the chassis 12 may operate the pump 40 as a pump, providing hydraulic power to the power system 30, which may be stored in a hydraulic storage device (not shown) for later supply of hydraulic power and/or to provide hydraulic power to other the remaining pumps 36, 38, which may supplement power of engine 32. Similarly, the pump 42 may act as a motor when travel is commanded, and be capable of slowing and stopping the ground-engaging members 14 in a regenerative manner that results in hydraulic energy being generated that may be rerouted to provide hydraulic power to the power system 30, and similarly stored and/or otherwise utilized to supplement power of engine 32. For the purposes of this disclosure, however, such pumps/motors will be referenced as pumps.

While fixed displacement pumps may be utilized except where otherwise designated herein, in the illustrated embodiment, the pumps 36, 38, 40, 42 are variable displacement pumps. The pumps 36, 38, 40, 42 may be swashplate-type pumps and include multiple piston bores, and pistons held against a tiltable swashplate. The pistons may reciprocate in the bores to produce a pumping action as the swashplate rotates relative to the pistons. The swashplate may be selectively tilted relative to the longitudinal axis of the pistons to vary a displacement of the pistons within their respective bores. The angular setting of the swashplate relative to the pistons may be carried out by any actuator known in the art, for example, by a servo motor. Although the structure of the pumps 36, 38, 40, 42 is not illustrated in detail, those of skill in the art will appreciate the structure, which is known in the art. Further, although the exemplary embodiment shown includes four pumps 36, 38, 40, 42, a two pumps, or more than two pumps may be utilized. Similarly, although two pumps 36, 38 are illustrated as coupled to the engine 32, a single pump or more than two pumps may be used in this capacity as well.

In the exemplary embodiment shown in FIG. 2, the pumps 36, 38, are hydraulically coupled to control valves 50, such that the pumps 36, 38 supply pressurized fluid to control valves 50, which, in turn, control fluid flow to and from hydraulic devices of machine 10. For the purposes of this disclosure, the "control valves 50" may include one or more hydraulic valves that control and direct hydraulic flow to and from various hydraulic fluid connections. For example, as shown in FIG. 2, the control valves 50 are hydraulically coupled to the hydraulic actuators 24, 26, and 28, and pumps 40, 42, which, when supplied with pressurized fluid flow, operate to provide a swing motion to the cab 16 and drive ground-engaging members 14, respectively. Although a single hydraulic pump 42 is shown with regard to driving of the ground-engaging members 14, the power system 30 may include one or more hydraulic pumps, for example, one for each of the ground-engaging members 14.

According to some embodiments, the engine 32 may drive the power transforming devices, such as the hydraulic pumps 36, 38, 40, 42, through a transmission (not illustrated). The transmission may comprise a mechanical transmission having multiple gear ratios. The transmission may further include a torque converter. According to some embodiments, the transmission may be in the form of a continuously variable transmission. It should be understood that the present disclosure is applicable to any suitable drive arrangement between the engine and the pump.

The hydraulic system 31 may further include one or more relief valves to control or limit the pressure in the hydraulic system 31 or an associated device or passage. The pressure is relieved by allowing the pressurized fluid to flow through the relief valve, typically to a tank (not shown) so that it may be reused within the hydraulic system 31. Relief valves are normally closed and are typically designed or set to open at a predetermined set pressure or cracking pressure to protect the associated passage, device, or system from being subjected to pressures that exceed their design limits. When the set pressure is exceeded, the relief valve becomes the "path of least resistance" as the valve is forced open and a portion of the fluid is diverted through the auxiliary route. The relief valves may be of any appropriate design.

The embodiment of FIG. 2 includes a main relief valve 54 in association with the control valves 50. For the purposes of this disclosure, the main relief valve will be referenced as a first relief valve 54. The embodiment also includes a second relief valve 56, here, a swing relief valve, associated with the swing pump 40, although additional relief valves may be provided throughout the system. The respective set pressures of the first relief valve 54 and the second relief valve 56 are typically set during assembly of the hydraulic system 31 and the machine 10. Sensors may also be provided that are arranged and configured to monitor opening of the first relief valve 54 and the second relief valve 56. In one or more embodiments, the set pressure of the first relief valve 54 is higher than the set pressure of the second relief valve 56, which is generally associated with operation of the second pump.

The power system 30 may also include one or more sensors for monitoring operation of the power system. For example, the power system may include a sensor 60 associated with the engine 32, for example, an engine speed sensor 60 configured and arranged to monitor a speed of the engine. Other sensors associated with the engine may include a mass air-flow sensor, an emissions sensor, a manifold pressure sensor, a turbocharger boost pressure sensor, and/or other engine-related sensors. Sensors 62, 64, 66, 68 may also be provided in association with the pumps 36, 38, 40, 42. Pump sensors 62, 64, 66, 68 may be configured and arranged to monitor the pressure or output flow rate of the associated pump, for example. Such a pressure sensor may be is arranged and configured to monitor the discharge pressure of the associated pump. When the pump is a variable displacement pump, a pump flow rate sensor may, for example, be arranged and configured to monitor the displacement of the pump. According to other embodiments including those using a fixed displacement pump, the pump flow rate sensor may be a speed sensor associated, for example, with the impeller of the pump. Sensors 72, 74, 76 may also be associated with the hydraulic actuators 24, 26, 28 to provide, active readings of the pressures developed in the respective hydraulic actuators 24, 26, 28. Each of the sensors 60, 62, 64, 66, 68, 72, 74, 76 may provide respective signals indicative of the associated reading to the controller 33.

The power system may include an operator interface 78 to be used by a machine operator for entering commands relating to one or more functions of the machine 10. The operator interface 78 may be arranged in the cab 16 of the machine 10 or alternatively it may be located remote from the machine 10. The operator interface 78 may include one or more control device such as, for example, levers, pedals, joysticks, switches, wheels and/or buttons for controlling the machine 10 and its functions. For example, with respect to the illustrated embodiment, the operator interface 78 may include lever inputs for one or more of directing movement of the boom, movement of the stick, movement of the bucket, rotation or swing of the cab on the chassis, and movement of the machine through the ground engaging members. The operator interface may also be configured to permit the operator to enter a desired power setting for the machine. For example, the operator interface may be configured to allow an operator to choose between high power, low power and/or economy settings.

The operator interface may be configured with a kick-out control device (e.g., a switch or button) that allows an operator to de-activate the adjustment of the power system operating parameters performed by the controller 33. This kick-out switch may be used by an operator in situations where the operator desires the machine to respond in a particular manner without any adjustments performed by the controller 33. For example, the controller 33 may be configured such that when the kick-out is activated by the operator, the controller 33 sets the power system to a defined set of operating parameters (e.g., machine power limit, engine speed, pump displacement). For example, when the kick-out is activated, the controller 33 may set the power system to the maximum machine power limit, engine speed and hydraulic pressure (which may be controlled via pump displacement).

Turning now to the controller 33, during operation of the machine 10, the controller 33 may be adapted to receive and process information from the operator interface 78 and the various sensors 60, 62, 64, 66, 68, 72, 74, 76 relating to the operation of the machine 10. From information received, the controller 33 may also determine certain operations of the machine 10, such as whether the machine 10 is traveling, or whether the machine 10 is idling. The controller 33 may be further adapted to process the information it receives and to control operation of the engine 32 and/or one or more of the hydraulic pumps 36, 38, 40, 42. For example, the controller 33 may be configured to adjust the speed of the engine 32 by adjusting the fueling of the engine 32. Additionally, the controller 33 may be further configured to use adjustments in the displacement of the pumps 36, 38, 40, 42 to adjust the respective motion of the pump, pump flow rate and/or the pressure in the hydraulic system 31. As shown in FIG. 2, the controller 33 may be capable of communicating with components of power system 30, such as the engine 32, the pumps 36, 38, 40, 42 and the sensors 60, 62, 64, 66, 68, 72, 74, 76 via either wired or wireless transmission and, as such, controller 33 may be connected to or alternatively disposed in a location remote from the machine 10.

The controller 33 may include a processor (not shown) and a memory component (not shown). The processor may be microprocessors or other processors as known in the art. In some embodiments the processor may be made up of multiple processors. Instructions associated with the methods described may be read into, incorporated into a computer readable medium, such as the memory component, or provided to an external processor. In alternative embodiments, hard-wired circuitry may be used in place of or in combination with software instructions. Thus, embodiments are not limited to any specific combination of hardware circuitry and software.

The term "computer-readable medium" as used herein refers to any medium or combination of media that is non-transitory, participates in providing computer-executable instructions to a processor for execution facilitating performing a method, implemented by a programmable controller. Such a medium may take many forms, including but not limited to, non-volatile media, volatile media, and transmission media. Non-volatile media includes, for example, optical or magnetic disks. Volatile media includes dynamic memory. Transmission media includes coaxial cables, copper wire and fiber optics.

Common forms of computer-readable media include, for example, a floppy disk, a flexible disk, hard disk, magnetic tape, or any other magnetic medium, a CD-ROM, any other optical medium, punchcards, papertape, any other physical medium with patterns of holes, a RAM, a PROM, and EPROM, a FLASH-EPROM, any other memory chip or cartridge, or any other medium from which a computer or processor can read.

The memory component may include any form of computer-readable media as described above. The memory component may include multiple memory components.

The controller 33 may be a part of a control module may be enclosed in a single housing. In alternative embodiments, the control module may include a plurality of components operably connected and enclosed in a plurality of housings. In still other embodiments the control module may be located in single location or a plurality of operably connected locations including, for example, being fixedly attached to the machine 10 or remotely to the machine 10.

To provide allow for automatic reactive management of the power system 30, the controller 33 may be configured to adjust one or more operating components of the power system 30 based on information received by the controller 33 relating to the how the machine 10 is being operated by the operator and/or commands from the operator. In particular, the controller 33 may control the operation of the pumps 36, 38, 40, 42 to minimize the actuation of the first relief valve 54 and the second relief valve 56 during operation of the power system 30, including the hydraulic system 31.

For the purposes of the disclosed method and claims of this disclosure, the pump 36 will be identified as a first pump 36 and the pump 40 associated with the swing function will be identified as a second pump 40. It will be appreciated, however, that alternate of the pumps 36, 38, 40, 42 may be designated as the first and second pumps. Further, for the purposes of this explanation of the methods of this disclosure, both the first and second pumps 36, 40 are variable displacement pumps.

Figure 3:
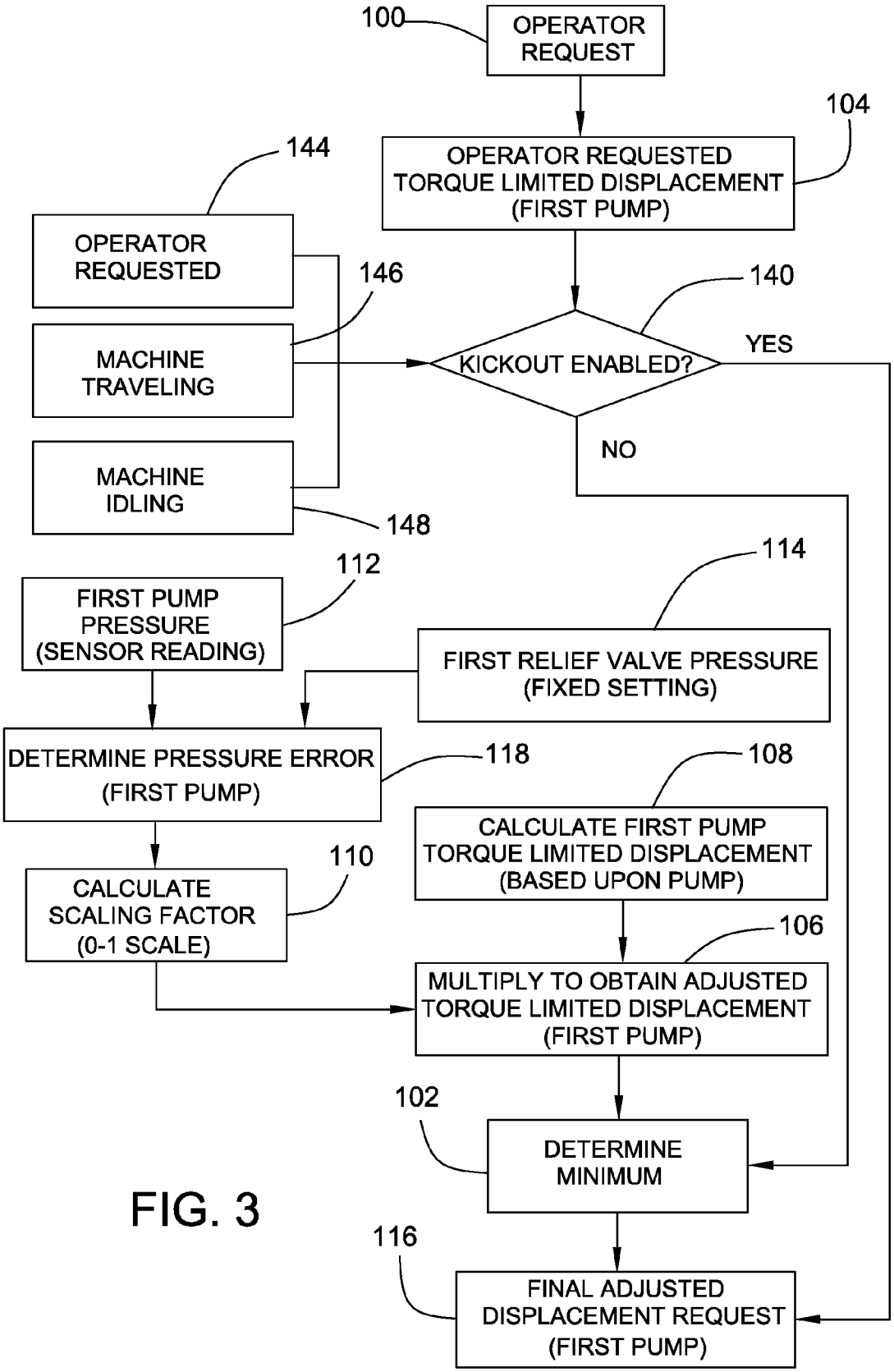
FIG. 3 is a flow chart illustrating one method of controlling operation of a first pump according to the present disclosure.
Figure 4:
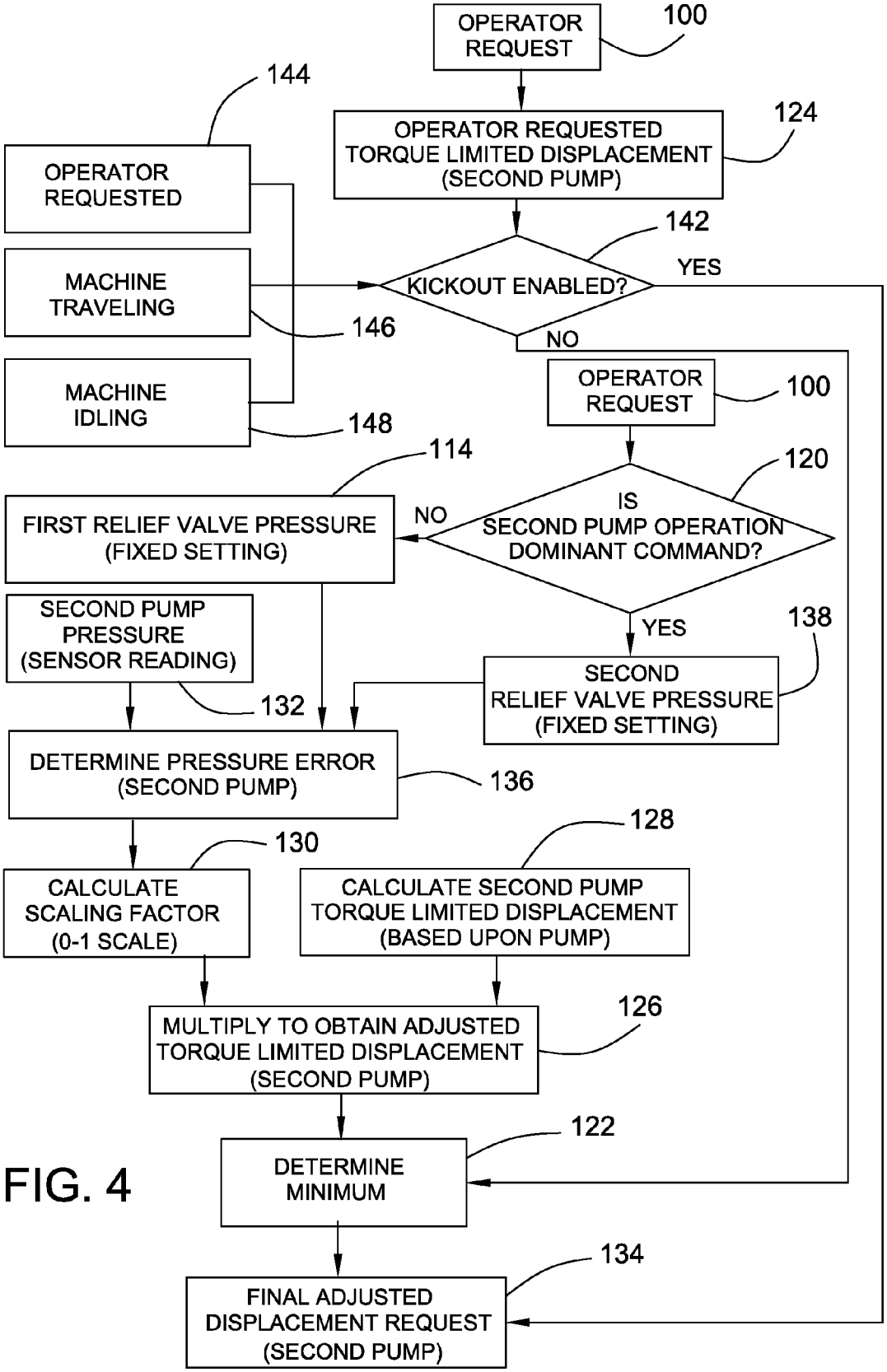
FIG. 4 is a flow chart illustrating one method of controlling operation of a second pump according to the present disclosure.

FIGS. 3 and 4 illustrate a method of controlling operation of the first and second pumps 36, 40, respectively, implemented by the programmable controller 33 to limit actuation of the first relief valve 54 and the second relief valve 56 by using variable pressure limiting to balance the output flow of the respective pump 36, 40 with the relief valves 54, 56 pressure characteristic. More specifically, the method reduces the respective pump 36, 40 outlet flow to just after the set pressure of the relief valve 54, 56 using a proportional pressure control if the operation commanded by the operator would yield a pump outlet pressure flow greater than the relief valve set pressure

INDUSTRIAL APPLICABILITY

Turning first to FIG. 3, which applies to the operation and control of the first pump 36, according to a specific feature of a method according to this disclosure, the controller 33 determines a minimum (see box 102) of the operator requested torque limited displacement of the first pump 36 (see box 104) and an adjusted torque limited displacement for the first pump 36 (see box 106) calculated based upon and a first pump torque limited displacement (see box 108) and a first pump scaling factor (see box 110) based upon a current pressure at the first pump 36 (see box 112) and a pressure setting at the first relief valve 54 (see box 114). The controller 33 provides that minimum of the torque limited displacement requested by the operator of the first pump 36 versus the adjusted torque limited displacement for the first pump 36 as a final adjusted displacement first pump request (see box 116).

More specifically, the method includes comparing the current pressure at the first pump 36 (see box 112) with the pressure setting at the first relief valve 54 (see box 114) to determine a pressure error for the first pump 36 (see box 118). The current pressure at the first pump 36 may be determined, for example, based upon the associated sensor 62 reading. The pressure error for the first pump 36 is then used to determine the first pump scaling factor (see box 110). According to one or more embodiments, the first pump scaling factor is a number between 0 and 1, inclusive. The first pump scaling factor (see box 110) is then multiplied by torque limited displacement of the first pump 36, which number is then compared with the operator requested torque limited displacement for the first pump 36 to determine the minimum (see box 102), which is then set as the final adjusted displacement request for the first pump 36 (see box 116). It will be appreciated that the final adjusted displacement request for the first pump 36 is a dynamic determination in that data is continually supplied to the controller 33 in using the method set forth in FIG. 3.

Turning now to FIG. 4, in contrast to the method as applied to the first pump 36, the method as applied to the second pump 40 is also determined in part upon other aspects of the operator request (see boxes 100 of FIG. 3). According to embodiments of the disclosure, the disclosed method may be applied a set forth in FIG. 4 alone, or as set forth in FIGS. 3 and 4 in combination. More specifically, in operation, the operator may request multiple movements at one time, such as, for example, operation of one or more of the hydraulic actuators 24, 26, 28 while rotating the cab 16 relative to the chassis 12. If the function of the second pump 40, is not the dominant command of the operator request, then the method applied to the second pump 40 is similar to that set forth in FIG. 3 with regard to the first pump 36, i.e., information from the second pump and first relief valve 54 is utilized to determine the adjusted torque limited displacement (box 126). For example, when the second pump 40 is associated with rotation of the cab 16 relative to the chassis 12, if swing is not the dominant command of the operator request, then the method as applied to the second pump 40 is similar to that set forth in FIG. 3 with regard to the first pump 36, only using information from the second pump 40 and the first relief valve 54.

In other words, the controller 33 determines a minimum (see box 122) of the operator requested torque limited displacement of the second pump 40 (see box 124) and an adjusted torque limited displacement for the second pump 40 (see box 126) calculated based upon and a second pump torque limited displacement (see box 128) and a second pump scaling factor (see box 130) based upon a current pressure at the second pump 40 (see box 132) and the pressure setting at the first relief valve 54 (see box 114). The controller 33 provides that minimum of the torque limited displacement requested by the operator of the second pump 40 versus the adjusted torque limited displacement for the second pump 40 as a final adjusted displacement second pump request (see box 134).

More specifically, the method includes comparing the current pressure at the second pump 40 (see box 132) with the pressure setting at the first relief valve 54 (see box 114) to determine a pressure error for the second pump 40 (see box 136). The current pressure at the second pump 40 may be determined, for example, based upon the associated sensor 66 reading. The pressure error for the second pump 40 is then used to determine the second pump scaling factor (see box 130). According to one or more embodiments, the second pump scaling factor is a number between 0 and 1, inclusive. The second pump scaling factor (see box 130) is then multiplied by the torque limited displacement of the second pump 40, which number is then compared with the operator requested torque limited displacement for the second pump 40 to determine the minimum (see box 122), which is then set as the final adjusted displacement request for the second pump 40 (see box 134).

If the operation of the second pump 40 is not the dominant command (see box 120) based upon the operator request (see boxes 100 in FIG. 4), however, an alternate method is applied. More specifically, rather than applying the first relief valve set pressure (i.e., as in box 114), the method uses the set pressure of the second relief valve 56 (see box 138) to determine the pressure error (see box 136). That is, in the case of the second pump 40 being the swing pump, if swing is the dominant command, the method utilizes the second relief valve 56, which is associated with the second pump 40, in calculating the pressure error (box 136), scaling factor for the second pump 40 (see box 130), the adjusted torque limited displacement for the second pump 40 (see box 126), and the final adjusted displacement request for the second pump 40 (see boxes 122 and 134).

As with the first pump 36, the controller 33 provides a signal to the second pump 40 to command operation of the second pump 40 consistent with this final adjusted displacement request (box 134). Further, as with the first pump 36, it will be appreciated that the final adjusted displacement request for the second pump 40 is a dynamic determination in that data is continually supplied to the controller 33 in using the method set forth in FIG. 4.

It will further be appreciated that, for the purposes of the method as illustrated in FIGS. 3 and 4, the second pump may be an alternate pump within the hydraulic system 31. In such a circumstance, a relief valve directly associated with that alternate pump would be identified as the second relief valve. Similarly, the method would determine if the operation associated with that alternate pump was the dominant command.

As another aspect of the disclosure, some embodiments may further consider one or more of an operator request and certain machine operating conditions as a kickout, overriding application of the above variable pressure limiting control arrangement with regard to the operation of the first and second pumps 36, 40. More specifically, if kickout is not enabled (see box 140 in FIG. 3 and box 142 in FIG. 4), then the variable pressure limiting control arrangement proceeds with regard to the operation of both the first and second pumps 36, 40 according to the method discussed above. If, however, kickout is enabled (see box 140 in FIG. 3 and box 142 in FIG. 4), then the variable pressure limiting control arrangement insofar as it is discussed above is bypassed, and the torque limited displacements requested by the operator for the first and second pumps 36, 40 are provided as the final adjusted displacement requests for the first and second pumps 36, 40, respectively (see box 116 in FIG. 3 and box 134 in FIG. 4).

While any appropriate kickout may be utilized, in the illustrated embodiment kickouts may include an operator request (see box 144), if the machine 10 is traveling (see box 146), and if the machine 10 is idling (see box 148). It will be appreciated, however, that alternate or additional kickouts may be incorporated and the kickouts may be identified by any appropriate method.

Thus, the present disclosure is applicable to control of a hydraulic system 31 including a plurality of variable displacement pumps and relief valves, providing variable and varied pressure control to a plurality of pumps balanced based on the associated relief valve's flow/pressure characteristic.

In some embodiments, the control strategy is designed to work not only with the first relief valve, but also with any other relief valve in the hydraulic system. That is, if an alternate pump is identified as the second pump, then a relief valve associated with or in line with the flow output of that pump may be utilized as the second relief valve in the above control system.

Some embodiments may yield fuel savings over conventional control systems.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. In a machine having moveable ground engaging members, a hydraulic system having a pump, and a first and second relief valves, the second relief valve being associated with the pump, wherein the pump is a variable displacement hydraulic pump, a method of controlling operation of the pump implemented by a programmable controller, the method comprising:

receiving an operator request for operation of the machine, determining if the operator request of the pump includes a dominant command associated with operation of the pump, determining a minimum torque limited displacement of the pump based on a comparison of an operator requested torque limited displacement of the pump and an adjusted torque limited displacement for the pump, wherein if the operator request includes the dominant command associated with operation of the pump, calculating the adjusted torque limited displacement for the pump using a pump torque limited displacement and a scaling factor based upon a current pressure at the pump and a pressure setting at the second relief valve, if the operator request does not include the dominant command associated with operation of the pump, calculating the adjusted torque limited displacement for the pump using a pump torque limited displacement and a scaling factor based upon a current pressure at the pump and a pressure setting at the first relief valve, and setting the minimum torque limited displacement of the pump as a final adjusted displacement pump request.

2. The method of claim 1 wherein the hydraulic system further includes a first pump, the pump of claim 1 being a second pump, and the second relief valve associated with the second pump, wherein the first and second pumps are variable displacement hydraulic pumps, the method being a method of controlling operation of the first and second pumps implemented by the programmable controller, the method comprising:

receiving an operator request for operation of at least one of the first and second pumps;

determining a minimum torque limited displacement of the first pump based on a comparison of the operator requested torque limited displacement of the first pump and an adjusted torque limited displacement for the first pump calculated based upon and a first pump torque limited displacement and a first pump scaling factor based upon a current pressure at the first pump and a pressure setting at the first relief valve, providing a signal setting the minimum torque limited displacement of the first pump as a final adjusted displacement first pump request, determining if the operator request of the first and second pumps includes a dominant command associated with operation of the second pump, determining a minimum torque limited displacement of the second pump based on a comparison of the operator requested torque limited displacement of the second pump and an adjusted torque limited displacement for the second pump, wherein if the operator request includes the dominant command associated with operation of the second pump, calculating the adjusted torque limited displacement for the second pump using a second pump torque limited displacement and a scaling factor based upon a current pressure at the second pump and a pressure setting at the second relief valve, if the operator request does not include the dominant command associated with operation of the second pump, calculating the adjusted torque limited displacement for the second pump using a second pump torque limited displacement and a scaling factor based upon a current pressure at the second pump and a pressure setting at the first relief valve, and setting the minimum torque limited displacement of the second pump as a final adjusted displacement second pump request.

3. The method of claim 2 further including determining if a predetermined kickout operation has been enabled;

if the predetermined kickout operation has not been enabled, following the steps of claim 1; and if the predetermined kickout operation has been enabled, providing a signal setting an operator requested torque limited displacement of the first pump as the final adjusted displacement first pump request, and providing a signal setting an operator requested torque limited displacement of the second pump as the final adjusted displacement second pump request.

4. The method of claim 3 wherein the step of determining if a predetermined kickout operation has been enabled includes at least one of the following:

determining if an operator request has been enabled, determining if the machine is traveling, and determining if the machine is idling.

5. The method of claim 3 wherein, when the predetermined kickout operation has not been enabled and the operator request includes the dominant command associated with operation of the second pump, then the step of calculating the adjusted torque limited displacement for the second pump using a second pump torque limited displacement and a scaling factor based upon a current pressure at the second pump and a pressure setting at the second relief valve includes comparing the current pressure at the second pump with a pressure setting at the second relief valve to determine a second pump pressure error, calculating the second pump scaling factor using the second pump pressure error, calculating the second pump torque limited displacement, multiplying the second pump scaling factor by the calculated second pump torque limited displacement to obtain the adjusted torque limited displacement for the second pump.

6. The method of claim 3 wherein, when the predetermined kickout operation has not been enabled and the operator request does not include the dominant command associated with operation of the second pump, then the step of calculating the adjusted torque limited displacement for the second pump using a second pump torque limited displacement and a scaling factor based upon a current pressure at the second pump and a pressure setting at the first relief valve includes comparing the current pressure at the second pump with a pressure setting at the first relief valve to determine a second pump pressure error, calculating the second pump scaling factor using the second pump pressure error, calculating the second pump torque limited displacement, multiplying the second pump scaling factor by the calculated second pump torque limited displacement to obtain the adjusted torque limited displacement for the second pump.

7. The method of claim 3 wherein when the predetermined kickout operation has not been enabled and the operator request includes the dominant command associated with operation of the second pump, then the step of calculating the adjusted torque limited displacement for the second pump using a second pump torque limited displacement and a scaling factor based upon a current pressure at the second pump and a pressure setting at the second relief valve includes comparing the current pressure at the second pump with a pressure setting at the second relief valve to determine a second pump pressure error, and, calculating the second pump scaling factor using the second pump pressure error, calculating the second pump torque limited displacement, multiplying the second pump scaling factor by the calculated second pump torque limited displacement to obtain the adjusted torque limited displacement for the second pump, and when the predetermined kickout operation has not been enabled and the operator request does not include the dominant command associated with operation of the second pump, then the step of calculating the adjusted torque limited displacement for the second pump using a second pump torque limited displacement and a scaling factor based upon a current pressure at the second pump and a pressure setting at the first relief valve includes comparing the current pressure at the second pump with a pressure setting at the first relief valve to determine the second pump pressure error, calculating the second pump scaling factor, calculating the second pump torque limited displacement, multiplying the second pump scaling factor by the calculated second pump torque limited displacement to obtain the adjusted torque limited displacement for the second pump.

8. The method of claim 7 wherein the step of determining if a predetermined kickout operation has been enabled includes at least one of the following:

determining if an operator request has been enabled, determining if the machine is traveling, and determining if the machine is idling.

9. The method of claim 2 wherein, when the operator request includes the dominant command associated with operation of the second pump, then the step of calculating the adjusted torque limited displacement for the second pump using a second pump torque limited displacement and a scaling factor based upon a current pressure at the second pump and a pressure setting at the second relief valve includes comparing the current pressure at the second pump with a pressure setting at the second relief valve to determine a second pump pressure error, calculating the second pump scaling factor using the second pump pressure error, calculating the second pump torque limited displacement, multiplying the second pump scaling factor by the calculated second pump torque limited displacement to obtain the adjusted torque limited displacement for the second pump.

10. The method of claim 2 wherein, when the operator request does not include the dominant command associated with operation of the second pump, then the step of calculating the adjusted torque limited displacement for the second pump using a second pump torque limited displacement and a scaling factor based upon a current pressure at the second pump and a pressure setting at the first relief valve includes comparing the current pressure at the second pump with a pressure setting at the first relief valve to determine a second pump pressure error, calculating the second pump scaling factor using the second pump pressure error, calculating the second pump torque limited displacement, multiplying the second pump scaling factor by the calculated second pump torque limited displacement to obtain the adjusted torque limited displacement for the second pump.

11. The method of claim 2 wherein when the operator request includes the dominant command associated with operation of the second pump, then the step of calculating the adjusted torque limited displacement for the second pump using a second pump torque limited displacement and a scaling factor based upon a current pressure at the second pump and a pressure setting at the second relief valve includes comparing the current pressure at the second pump with a pressure setting at the second relief valve to determine a second pump pressure error, and, calculating the second pump scaling factor using the second pump pressure error, calculating the second pump torque limited displacement, multiplying the second pump scaling factor by the calculated second pump torque limited displacement to obtain the adjusted torque limited displacement for the second pump, and when the operator request does not include the dominant command associated with operation of the second pump, then the step of calculating the adjusted torque limited displacement for the second pump using a second pump torque limited displacement and a scaling factor based upon a current pressure at the second pump and a pressure setting at the first relief valve includes comparing the current pressure at the second pump with a pressure setting at the first relief valve to determine the second pump pressure error, calculating the second pump scaling factor, calculating the second pump torque limited displacement, multiplying the second pump scaling factor by the calculated second pump torque limited displacement to obtain the adjusted torque limited displacement for the second pump.

12. A non-transitory computer-readable medium including computer-executable instructions facilitating performing a method, implemented by a programmable controller, of controlling operation of first and second pumps in a hydraulic system in a machine including moveable ground engaging members, the first and second pumps being variable displacement hydraulic pumps and the hydraulic system further including a first relief valve and a second valve, the second valve being associated with the second pump, the method comprising:

receiving an operator request for operation of at least one of the first and second pumps;

determining a minimum torque limited displacement of the first pump based on a comparison of the operator requested torque limited displacement of the first pump and an adjusted torque limited displacement for the first pump calculated based upon and a first pump torque limited displacement and a first pump scaling factor based upon a current pressure at the first pump and a pressure setting at the first relief valve, providing a signal setting the minimum torque limited displacement of the first pump as a final adjusted displacement first pump request, determining if the operator request of the first and second pumps includes a dominant command associated with operation of the second pump, determining a minimum torque limited displacement of the second pump based on a comparison of the operator requested torque limited displacement of the second pump and an adjusted torque limited displacement for the second pump, wherein if the operator request includes the dominant command associated with operation of the second pump, calculating the adjusted torque limited displacement for the second pump using a second pump torque limited displacement and a scaling factor based upon a current pressure at the second pump and a pressure setting at the second relief valve, if the operator request does not include the dominant command associated with operation of the second pump, calculating the adjusted torque limited displacement for the second pump using a second pump torque limited displacement and a scaling factor based upon a current pressure at the second pump and a pressure setting at the first relief valve, and setting the minimum torque limited displacement of the second pump as a final adjusted displacement second pump request.

13. The non-transitory computer-readable medium of claim 12 further including determining if a predetermined kickout operation has been enabled;

if the predetermined kickout operation has not been enabled, following the steps of claim 1; and if the predetermined kickout operation has been enabled, providing a signal setting an operator requested torque limited displacement of the first pump as the final adjusted displacement first pump request, and providing a signal setting an operator requested torque limited displacement of the second pump as the final adjusted displacement second pump request.

14. The non-transitory computer-readable medium of claim 13 wherein the step of determining if a predetermined kickout operation has been enabled includes at least one of the following:

determining if an operator request has been enabled, determining if the machine is traveling, and determining if the machine is idling.

15. The non-transitory computer-readable medium of claim 13 wherein, when the predetermined kickout operation has not been enabled and the operator request includes the dominant command associated with operation of the second pump, then the step of calculating the adjusted torque limited displacement for the second pump using a second pump torque limited displacement and a scaling factor based upon a current pressure at the second pump and a pressure setting at the second relief valve includes comparing the current pressure at the second pump with a pressure setting at the second relief valve to determine a second pump pressure error, calculating the second pump scaling factor using the second pump pressure error, calculating the second pump torque limited displacement, multiplying the second pump scaling factor by the calculated second pump torque limited displacement to obtain the adjusted torque limited displacement for the second pump.

16. The non-transitory computer-readable medium of claim 15 wherein, when the predetermined kickout operation has not been enabled and the operator request does not include the dominant command associated with operation of the second pump, then the step of calculating the adjusted torque limited displacement for the second pump using a second pump torque limited displacement and a scaling factor based upon a current pressure at the second pump and a pressure setting at the first relief valve includes comparing the current pressure at the second pump with a pressure setting at the first relief valve to determine a second pump pressure error, calculating the second pump scaling factor using the second pump pressure error, calculating the second pump torque limited displacement, multiplying the second pump scaling factor by the calculated second pump torque limited displacement to obtain the adjusted torque limited displacement for the second pump.

17. The non-transitory computer-readable medium of claim 12 wherein, when the operator request includes the dominant command associated with operation of the second pump, then the step of calculating the adjusted torque limited displacement for the second pump using a second pump torque limited displacement and a scaling factor based upon a current pressure at the second pump and a pressure setting at the second relief valve includes comparing the current pressure at the second pump with a pressure setting at the second relief valve to determine a second pump pressure error, calculating the second pump scaling factor using the second pump pressure error, calculating the second pump torque limited displacement, multiplying the second pump scaling factor by the calculated second pump torque limited displacement to obtain the adjusted torque limited displacement for the second pump.

18. The non-transitory computer-readable medium of claim 12 wherein, when the operator request does not include the dominant command associated with operation of the second pump, then the step of calculating the adjusted torque limited displacement for the second pump using a second pump torque limited displacement and a scaling factor based upon a current pressure at the second pump and a pressure setting at the first relief valve includes comparing the current pressure at the second pump with a pressure setting at the first relief valve to determine a second pump pressure error, calculating the second pump scaling factor using the second pump pressure error, calculating the second pump torque limited displacement, multiplying the second pump scaling factor by the calculated second pump torque limited displacement to obtain the adjusted torque limited displacement for the second pump.

19. The non-transitory computer-readable medium of claim 12 wherein when the operator request includes the dominant command associated with operation of the second pump, then the step of calculating the adjusted torque limited displacement for the second pump using a second pump torque limited displacement and a scaling factor based upon a current pressure at the second pump and a pressure setting at the second relief valve includes comparing the current pressure at the second pump with a pressure setting at the second relief valve to determine a second pump pressure error, and, calculating the second pump scaling factor using the second pump pressure error, calculating the second pump torque limited displacement, multiplying the second pump scaling factor by the calculated second pump torque limited displacement to obtain the adjusted torque limited displacement for the second pump, and when the operator request does not include the dominant command associated with operation of the second pump, then the step of calculating the adjusted torque limited displacement for the second pump using a second pump torque limited displacement and a scaling factor based upon a current pressure at the second pump and a pressure setting at the first relief valve includes comparing the current pressure at the second pump with a pressure setting at the first relief valve to determine the second pump pressure error, calculating the second pump scaling factor, calculating the second pump torque limited displacement, multiplying the second pump scaling factor by the calculated second pump torque limited displacement to obtain the adjusted torque limited displacement for the second pump.

20. A moveable machine comprising moveable ground engaging members, a chassis supported on the moveable ground engaging members, a cab swingably supported on the chassis, a hydraulic system including at least first and second pumps, a first relief valve, and a second relief valve associated with the second pump, at least one operator interface for providing an operator request including commands for operation of the hydraulic system, and a programmable controller configured by computer-executable instructions to adjust respective pump discharge pressures of the first and second pumps, the instructions including determining and providing a signal associated with a final adjusted displacement for the first pump based at least in part on a pressure setting of the first relief valve, and determining and providing a signal associated with a final adjusted displacement for the second pump based upon at least in part on a pressure setting of the second relief valve if swing is a dominant motion command, and based upon at least in part on the pressure setting of the first relief valve if swing is not the dominant motion command, the programmable controller using a set of parameters including:

the operator request, the pressure setting of the first relief valve, the pressure setting of the second relief valve, a torque limited displacement of the first pump, a torque limited displacement of the second pump, a pressure of the first pump, and a pressure of the second pump.

21. The machine of claim 20 wherein the set of parameters further includes at least one of travel of the machine, idling of the machine, and operator request to disable an adjustment of respective pump discharge pressures based upon at least one of the first relief valve and the second relief valve.

* * * * *